United States Patent [19]

Milgram

[11] 4,213,298

[45] Jul. 22, 1980

[54] SELF-REVERSING HYDRAULIC CONTROL SYSTEM AND SELF-REVERSING PUMP INCORPORATING SUCH SYSTEM

[75] Inventor: Jerome H. Milgram, Cambridge, Mass.

[73] Assignee: Offshore Devices, Inc., Peabody, Mass.

[21] Appl. No.: 921,458

[22] Filed: Jul. 3, 1978

[51] Int. Cl.[2] ..... F15B 15/18

[52] U.S. Cl. ..... 60/369; 60/379; 417/347; 417/404; 417/900

[58] Field of Search ..... 60/369, 379, 403, 459; 91/304, 318, 420, 461; 417/279, 397, 403, 404, 900

[56] References Cited

U.S. PATENT DOCUMENTS

| | | | |
|---|---|---|---|
| 1,952,690 | 3/1934 | Strom | 60/379 X |
| 2,302,232 | 11/1942 | MacNeil | 91/318 X |
| 2,698,517 | 1/1955 | Witt | 91/318 X |
| 3,846,049 | 11/1974 | Douglas | 417/404 |

*Primary Examiner*—Edgar W. Geoghegan

[57] ABSTRACT

A self-reversing hydraulic control system for use with a device to be driven in opposite directional modes, especially a self-reversing pump driven by such a device. The system depends upon a flow sensing element disposed to sense flow associated with movement of the driven device and adapted to generate a stop signal responsive to the termination of such flow. A means responsive to the stop signal is then effective to shift the system from one directional mode to the other. Also featured is a sensor disposed to receive and transmit hydraulic fluid under pressure to drive the device, stoppage of the flow adapted to cause the sensor to shift position and to transmit pressurized hydraulic fluid pressure, as the stop signal via a hydraulic line. In preferred embodiments the self-reversing hydraulic control system has a two-position 4-way valve which is shifted in position by the hydraulic stop signal. Embodiments utilizing a single sensor and a pair of sensors are shown, in combination with special arrangements of check valves. A preferred construction of the sensor is also shown.

10 Claims, 9 Drawing Figures

FIG 2
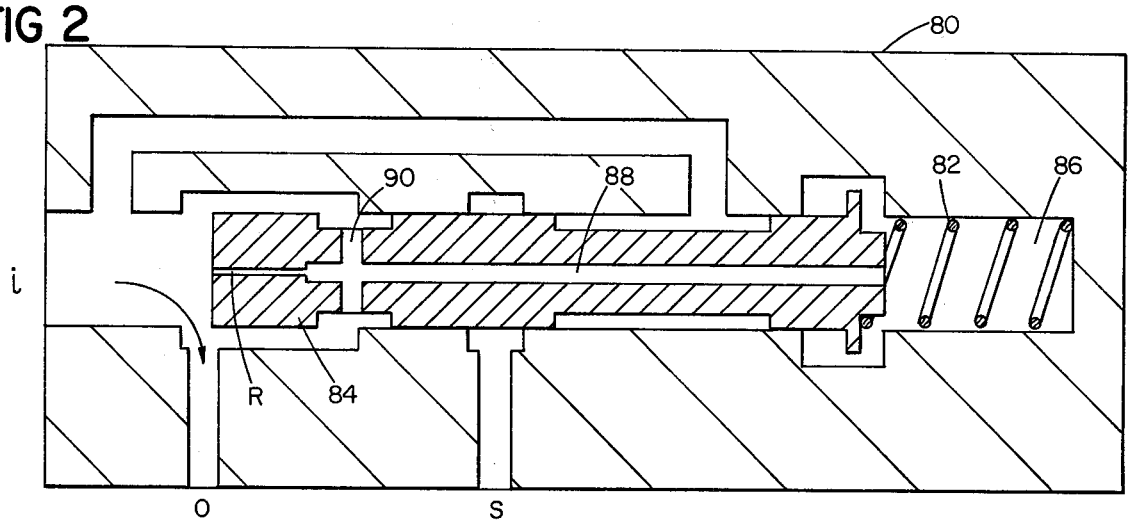
FIG 2a
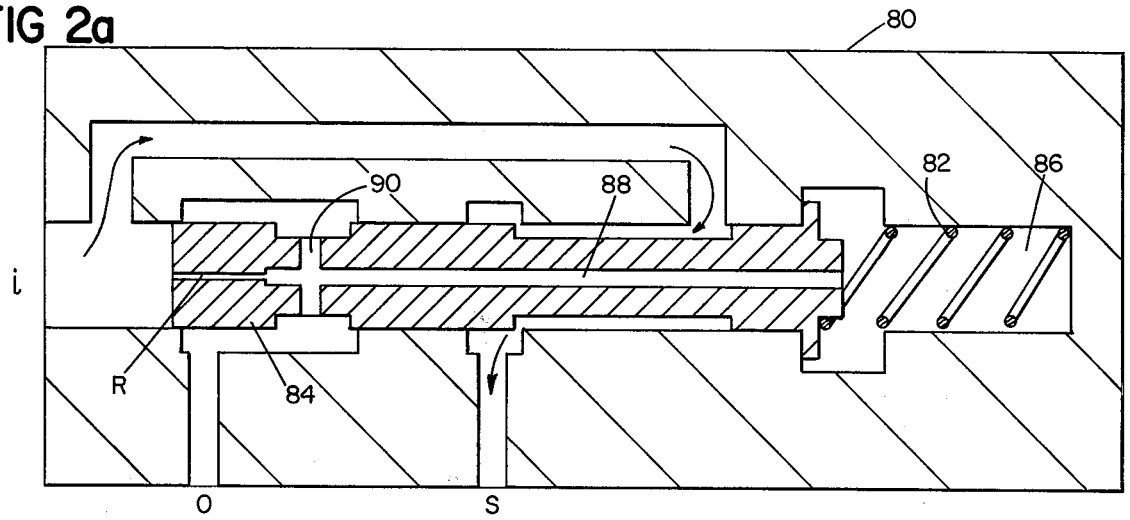
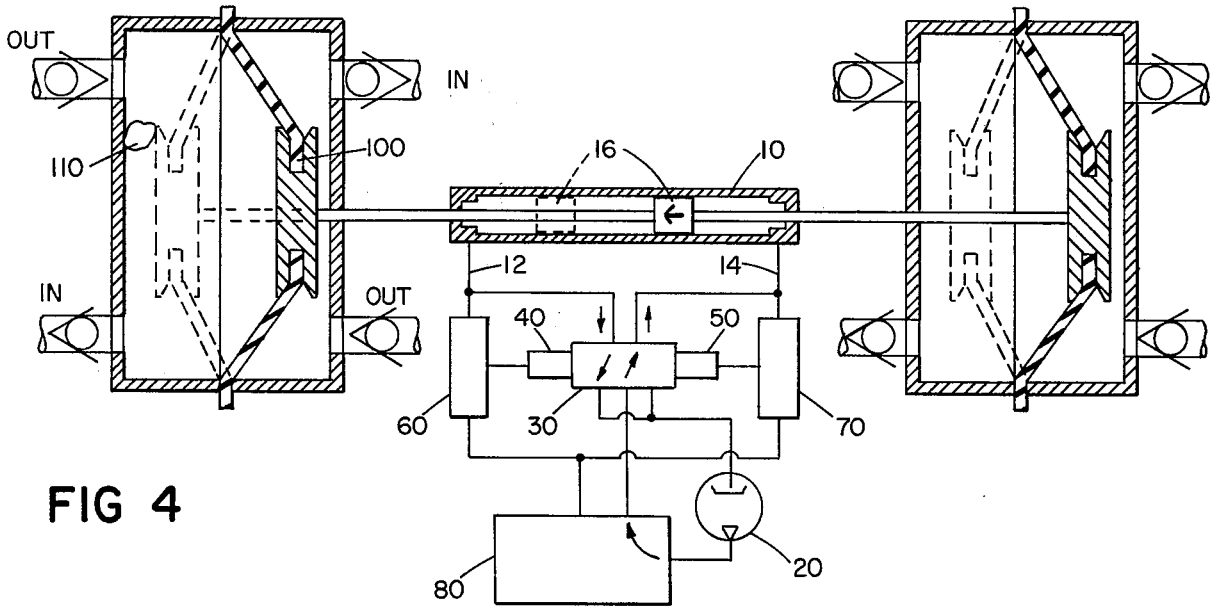
FIG 4

SELF-REVERSING HYDRAULIC CONTROL SYSTEM AND SELF-REVERSING PUMP INCORPORATING SUCH SYSTEM

BACKGROUND OF THE INVENTION

This invention concerns a system for reversing a reciprocating hydraulic device such as a hydraulic cylinder or a hydraulic motor used for reciprocating motion. The drive circuit for such device employs two hydraulic lines arranged so that when hydraulic fluid is applied to one line and withdrawn from the other the device moves in one direction, and when the direction of flow is reversed the device moves in the other direction. When applied to a pumping system, the invention relates to a pumping element such as a reciprocating diaphragm which is driven by such a self reversing hydraulic system.

OBJECTS OF THE INVENTION

One object of the invention is to provide a self-reversing hydraulic circuit adapted to reverse the reciprocating device at each end of its normal stroke. Another object is to enable the hydraulic circuit to reverse before the normal stroke is completed when an obstacle is encountered, a mode of operation not permitted by conventional sensing devices which sense the position of the reciprocating device when it reaches the end of its normal stroke.

A particular object of the invention is to provide a hydraulically driven reciprocating pump for conditions in which debris in the fluid being pumped can jam the pump. In such a case it is desirable to reverse direction of the pumping element in an attempt to flush the debris through the pump and to continue operation. Even if the debris remains within the pump, it is desired to continue the pumping action with the reciprocating motion within the limits of motion allowed by the debris. An object of the invention is to enable automatic partial stroke operation under these circumstances.

Another object of the invention is to provide a self-reversing hydraulic circuit of a type which is purely hydraulic and does not require electrical sensors or drivers. There are a number of applications, particularly those in the marine environment, where electrical components are adversely affected by long term exposure to salt air and salt water. It is an object of the invention to avoid these problems.

Still a further object of the invention is to provide an automatic, self-reversing hydraulic circuit which is reliable, requires only simple components, and permits the achievement of substantially positive or nearly positive displacement of the driven element.

SUMMARY OF THE INVENTION

The circuit of the invention is constructed and arranged such that if the hydraulically driven device is moving in one direction and then is stopped, i.e. either by encountering the limit stop of the stroke, or by encountering an obstruction to movement, the circuit senses the change in flow conditions in the hydraulic lines and reverses the flow direction on this basis. Thus if in normal operation the reciprocating device moves between one end stop and another, the device will move until it comes to one end stop where it will stall, the circuit will sense the change in flow and will reverse, and the reversed movement will proceed until the device comes to the other end stop. The circuit will reverse again and so forth. The same operation will occur when the device encounters an overpowering obstacle prior to the end of the normal stroke.

The invention features the use of a flow sensing device which generates a high pressure hydraulic stop signal when flow through the device stops. This hydraulic stop signal is utilized either directly or indirectly to operate a pilot element to shift the flow control valve to the reverse position. In one preferred embodiment a single flow sensor is employed in conjunction with pilot operated check valves to drive the flow control valve in either direction. In another preferred embodiment two flow sensors are employed, one for shifting in each direction, together with ordinary check valves.

DESCRIPTION OF PREFERRED EMBODIMENTS

Figure 1:
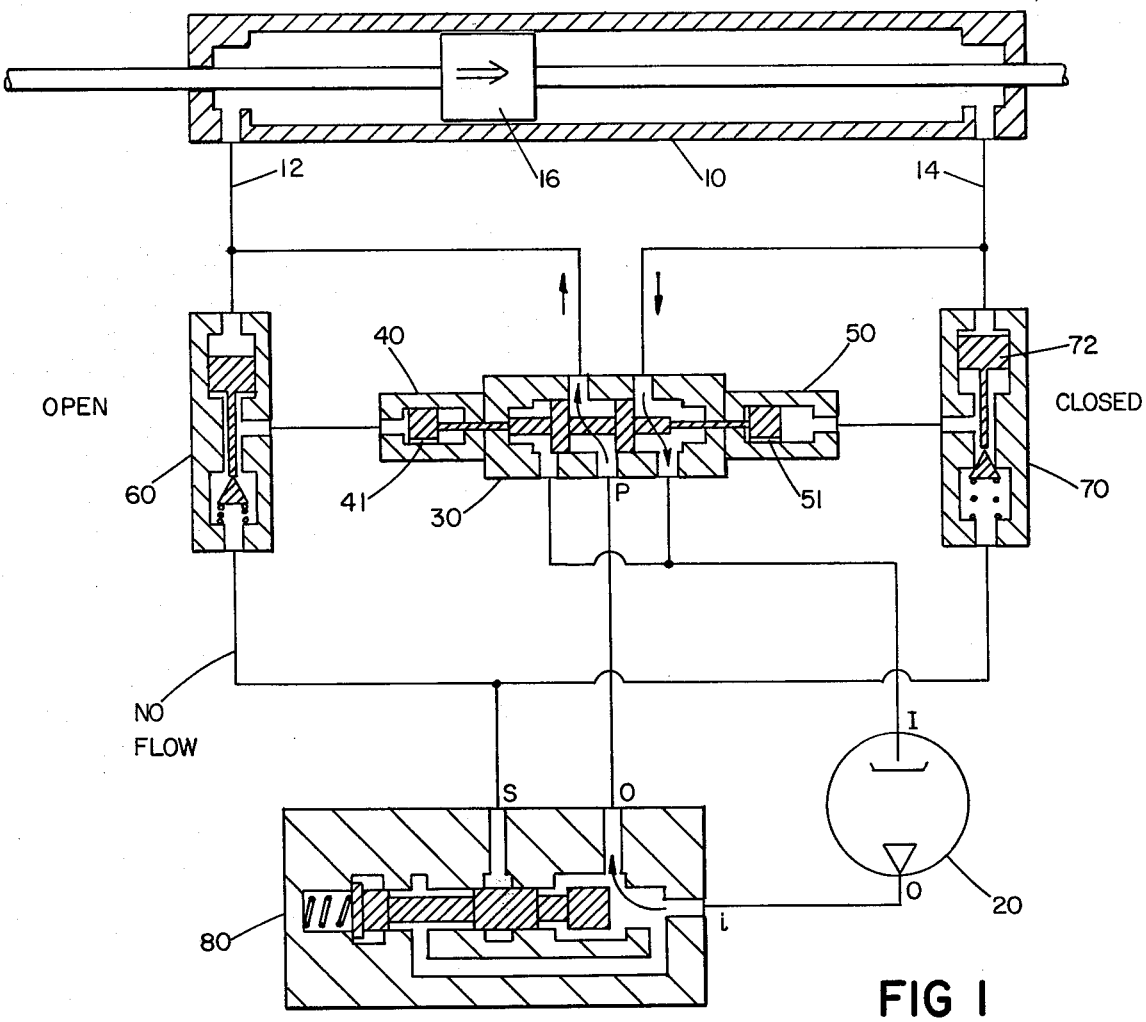
Figure 1A:
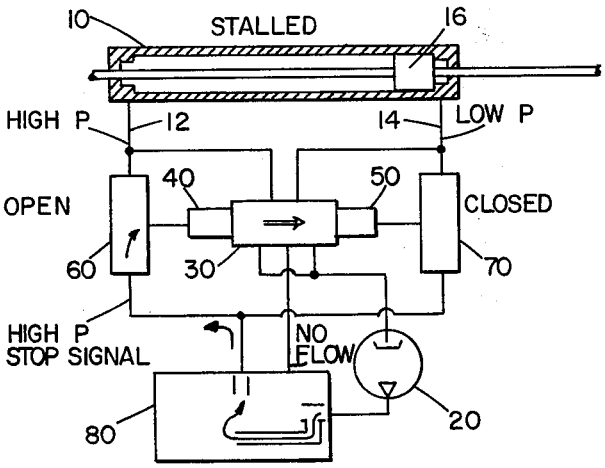
Figure 1B:
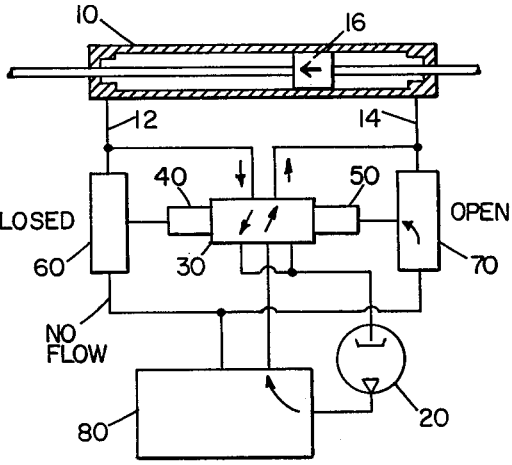
Figure 3:
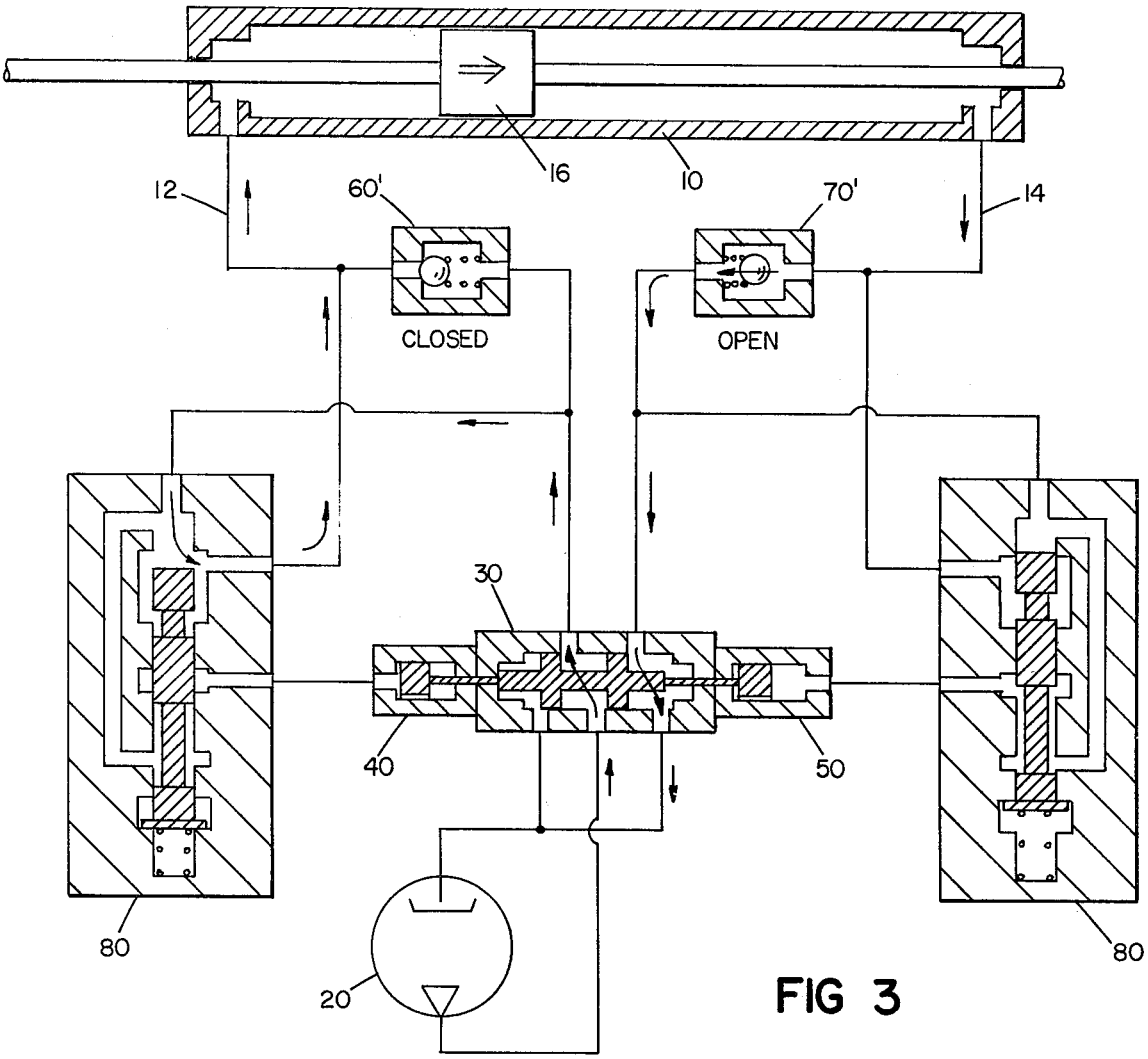
Figure 3A:
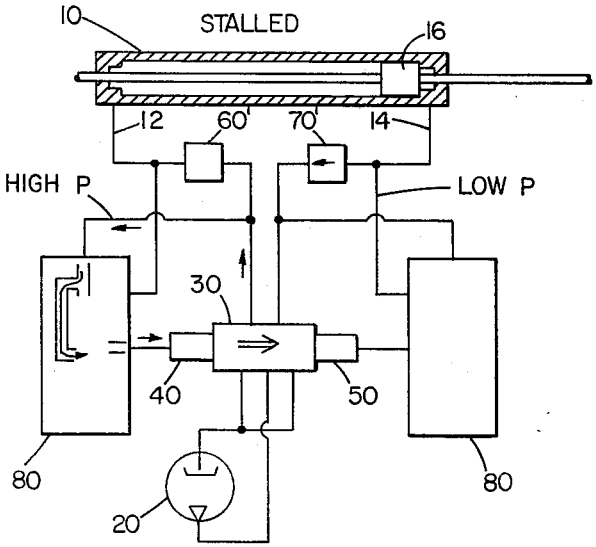
Figure 3B:
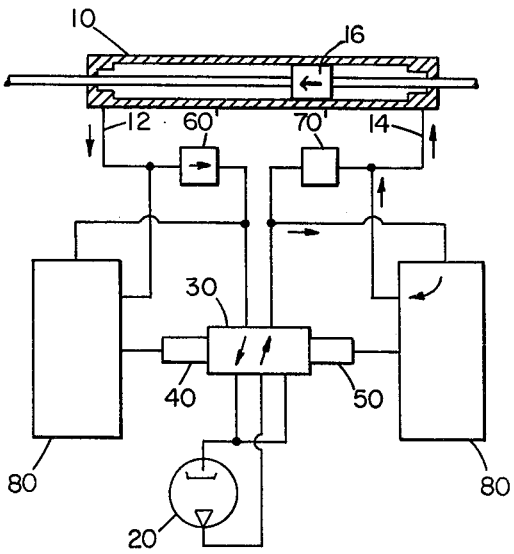

The above and numerous other objects and features of the invention will be understood from the following description of preferred embodiments wherein FIG. 1 is a cross-sectional view and FIGS. 1*a* and 1*b* are identical schematic views of the preferred embodiment of the invention showing the operative elements in different positions during a cycle of operation. FIGS. 2 and 2*a* are enlarged cross-sectional views of the flow sensing device of the invention in two different states of operation; FIGS. 3, 3*a* and 3*b* are views similar to FIGS. 1, 1*a* and 1*b* of an alternative embodiment; and FIG. 4 is a schematic view patterned after FIG. 1 of a pumping system, according to the invention.

Referring to FIG. 1 a reciprocating device to be driven, shown in the form of a double acting hydraulic cylinder 10, is connected to receive two hydraulic lines 12 and 14 at opposite ends of the cylinder. Hydraulic fluid supplied to one end through line 12 and withdrawn from the other end through line 14 causes the reciprocating element, i.e. the piston 16, to move in the direction of the arrow.

The pressurized hydraulic fluid for driving the reciprocating device is provided by hydraulic pump 20 which may be driven continuously. [This pump can for instance by any of a variety of positive displacement pumps, such as a piston pump or a gear pump, having the characteristic of supplying a substantially constant flow rate while capable of accepting considerable variation in pressure caused by load variation.] A two-position, four-way valve 30 directs fluid being withdrawn from the driven device to the inlet I of pump 20 and directs pressurized hydraulic fluid from the outlet O of pump 20 to the opposite end of the reciprocating device. The two-position four-way valve is operated by pilot pistons 40 and 50 which are identical in construction. These pilots are actuated by flow passing through pilot operated check valves 60, 70. The system is completed by a special flow sensing valve 80 which is the essential control element of the system. The output flow of the pump 20, flowing from output O, before reaching the input port P of control valve 30, flows through the flow sensing device 80, entering at input i and exiting at output o. The source of fluid controlled by the check valves is the stop signal hydraulic pressure appearing on output s of the flow sensor. The controlling pressure for these check valves is the pressure in the respective feed/exhaust lines 12 and 14 of the reciprocating hydraulic device.

OPERATION

When the reciprocating piston 16 is free to move in the direction toward the right, FIG. 1, the high pressure hydraulic fluid from pump 20 enters sensing device 80 at port i, comes out of the device at port o (see FIG. 2) and proceeds into the 4-way valve, thence to the drive line 12. (Exhaust fluid proceeds from line 14 back through valve 30 to the inlet I of pump 20.)

However, when the reciprocating piston 16 comes to an end stop, see FIG. 1*a*, or is stopped by any other means, the stoppage of flow through sensor 80 and out through its port o is sensed. A feature of sensor 80 is that when flow from i to o is stopped, high pressure fluid is applied to port s, see FIG. 2*a*, thus constituting a stop signal. This high pressure fluid is transmitted to both pilot operated check valves, 60, 70, but in the direction with respect to the valves such that there is no flow through either of the valves to the pilot cylinders, 40 or 50, unless one of the pilot operated check valves is opened by pilot pressure. While the reciprocating piston is being driven to the right as shown in FIG. 1, high pressure is applied to the left line 12 and to check valve 60 in FIG. 1 and the right hand line 14 and check valve 70 are connected through the 4-way valve to low pressure. Thus, for the example cited, while the reciprocating device is being driven to the right in the way described above, the left hand pilot operated check valve 60 is held open, and the right hand one 70 is kept closed by its internal spring. When the piston 16 is stopped as shown in FIG. 1a, pressure is still applied to its left hand inlet line 12 until the 4-way valve 30 is shifted. However, when piston 16 stops, high pressure hydraulic fluid is applied to both check valves 60, 70 by the sensor 80. Because the right hand check valve 70 is closed for the example given above, the high pressure signal does not reach pilot 50. However, the left hand valve 60 is open, and this results in the high pressure fluid passing through valve 60 and actuating pilot 40, thereby shifting the 4-way valve to reverse the direction of flow to the reciprocating piston. (Fluid displaced as the pistons of pilots 40 and 50 are driven leaks back, through passages 41, 51 formed by flats on the sides of the pistons; also, drains, not shown, are connected to the inner ends of the pilot pistons.) Thereupon the condition shown in FIG. l*b* is achieved and the piston 16 travels to the left.

When the piston 16 is again stopped, this time the right hand pilot operated check valve 70 is open and the left one 60 is closed so reversal again occurs.

FLOW SENSOR DETAILS

The above description is the operational procedure for the self-reversing circuit. The preferred design of the special flow sensing device 80 will not be described. All other individual components are standard, and well known, hydraulic devices.

Referring to FIG. 2*a*, the special flow sensing valve 80 is of spool type, held in the "closed" position by a weak spring 82. In closed position (FIG. 2*a*) the end of spool 84 closes the passage from the inlet i to the outlet o. When the reciprocating device (piston 16, FIG. 1) can be moved, (i.e. pressure at o is low) the hydraulic fluid presses spool 84 back against the spring 82, thereby opening the passage from i to o in sensor 80 and closing the passage from i to s, see FIG. 2. The hydraulic fluid in the space 86 surrounding the spring moves through the bore 88 in the spool and through the cross-holes 90 to the outlet, o. When the hydraulic device comes against the stop, the flow through sensor valve 80 stops and the pressures in the space surrounding i, the space surrounding o, and the space 86 surrounding the spring become equal (i.e. there becomes no pressure differential from i to o) and as a result there are no fluid pressure forces on the spool. The spring 82 then moves the spool into the closed position, FIG. 2a. It is especially important to note that as the spool comes to the closed position, the passage of fluid around the end of the spool from i to o is impeded so that it is essential for a small amount of flow to pass from i to o through another path in order for the device to achieve the fully closed position. This other path is through the restricted orifice R. This orifice is of small diameter in comparison to the cross-sections of the other flow paths through the device so that when the reciprocating device is being moved, the pressure at inlet i of the sensor device 80 moves the spool into the open position, with little flow going through the orifice R.

It is especially important to note that although the motion of the spool is controlled by pressure differentials developed in the valve itself, the valve is not a pressure sensing valve in any way. It is a flow sensing valve. The motion of the spool 84 is independent of the inlet pressure i for any specific flow. The entire operation of the valve is flow controlled. Device 80 is a flow sensing valve which senses when the reciprocating device can be moved, and during such times supplies hydraulic fluid to move it, and senses when the reciprocating device has come against the stop, at which time the device 80 supplies direction switching hydraulic fluid to outlet s.

FURTHER EMBODIMENTS

FIGS. 3, 3*a*, and 3*b* show an alternate hydraulic circuit which utilizes two sensing valves 80, two ordinary check valves 60', 70', and no pilot operated check valves. The ordinary check valves can be separate check valves in parallel with the flow sensing valves 80, or they can be built into the same housing as the sensing valves. Similarly, with the embodiment shown in FIGS. 1, 1*a* and l*b*, the pilot operated check valves can be built in the same housing as the flow sensing valve 80, as can the 4-way valve, 30, in either case.

FIG. 4 illustrates the circuit of FIG. 1 in a pumping system. Note in the FIG. 4 that as diaphragm 100 of the pump moves from the solid to the dotted line position debris 110 blocks the outlet and prevents further travel of the pump diaphragm 100 and the prime moving piston 16. This causes self-reversal of the system before the system reaches its normal end stop.

I claim:

1. A self-reversing hydraulic control system for use with a device to be driven in opposite directional modes, said driven device having hydraulic lines connected to its opposite sides to apply hydraulic fluid under pressure to one side of the device and apply exhaust conditions to the other side of the device, and vice versa, said control system including a flow sensing element disposed to sense flow associated with movement of said driven device and adapted to generate a stop signal responsive to the termination of said flow, said termination denoting stoppage of said driven device, and means responsive to said stop signal to shift the system from one directional mode to the other to cause said hydraulic fluid under pressure and said exhaust conditions to be oppositely applied to the opposite sides of the driven device.

2. The self-reversing hydraulic control system of claim 1 wherein said sensor is disposed to receive and transmit hydraulic fluid under pressure to drive said device, stoppage of said flow adapted to cause said sensor to shift position and to transmit pressurized hydraulic fluid pressure as said stop signal via a hydraulic line, and hydraulic means connected to and responsive to said stop signal to shift the mode of operation of said hydraulic system.

3. The self-reversing hydraulic control system of claim 2 having a two-position 4-way valve, said valve connected to receive pressurized hydraulic fluid on one line, and to exhaust hydraulic fluid on another line, and said valve having ports connected to opposite sides of the driven device, said 4-way valve having a first position in which pressurized hydraulic fluid is introduced to one side and exhausted from the other side of said driven device and a second position in which said flow conditions are reversed, said 4-way valve being pilot operated, and said hydraulic stop signal line connected to the pilot operating mechanism of said valve to shift said valve from one position to the other upon the occurrence of said stop signal.

4. The self-reversing hydraulic control system of claim 3 wherein there are two pilot pressure operated, spring biased check valves, one associated with each position of the 4-way control valve member, said hydraulic stop signal line of a single said sensor connected as a source of feed pressure to each of said check valves, and pilot pressure connections of said check valves connected to respective ends of the driven device such that so long as the control valve member is in one of its two positions, the check valve corresponding to the side of the driven device receiving pressurized hydraulic fluid is held open by pilot pressure while the opposite check valve is closed by its spring, said check valves enabling said hydraulic stop signal pressure to flow through the respective open check valve, and to operate said 4-way valve to shift it to the opposite position thereby to reverse the direction of the system.

5. The self-reversing hydraulic control system of claim 3 wherein there are two sensors, each connected to sense the flow to a respective side of said driver member, and means enabling said stop signal of a respective sensor to apply its pressure only to a respective side of said 4-way control valve, thereby to shift said valve to the opposite position when said stop signal appears.

6. The self-reversing hydraulic control system of claim 5 in which each of said sensors is connected in parallel with a check valve between the respective end of said driven device and the respective port of said 4-way control valve, said check valve arranged to prevent flow during the presence of drive pressure and to enable flow during the presence of exhaust conditions.

7. A pump unit including the self-reversing control system of any of the foregoing claims wherein a pumping member is directly driven in opposite directional modes by said hydraulically driven device, the stop signal generated by said flow sensing element denoting stoppage of said pumping member, and said means that is responsive to said stop signal to shift the system being effective to reverse the direction of said pump, thus permitting continued operation of the pump even when debris blocks full travel of said pumping member.

8. A flow sensor for use in activating a hydraulically driven element in response to cessation of flow in a hydraulic line, said sensor having inlet, outlet and signal ports and a valving means, said valving means responsive to the presence of a pressure differential between said inlet and outlet ports to maintain said valving means in a first position which maintains flow between said inlet and outlet ports and effectively prevents access of inlet pressure to said signal port and said valving means responsive to equalization of pressure between said inlet and outlet ports to maintain said valving means in a second position to transmit inlet pressure to said signal port.

9. The flow sensor of claim 8 including a body and a valve spool within said body urged toward said second position by a spring, said inlet port exposing an end face of the spool to inlet pressure and an oppositely directed face of said spool exposed to outlet pressure such that pressure differential between said inlet and outlet ports overcomes the effort of said spring and moves said spool member to its said first position, and equalization of said pressures upon stoppage of the hydraulic flow neutralizes the hydraulic forces on said spool and enables said spring to urge said spool to said second position.

10. The flow sensor of claim 9 including a restricted passage through said spool adapted to enable limited flow of fluid from said inlet during motion of said spool member to said second position.

* * * * *